219-121 SR
8/3/76 XR 3,973,075

United States Patent [19]
Borkowski

[11] 3,973,075
[45] Aug. 3, 1976

[54] HIGH TEMPERATURE FURNACE

[75] Inventor: Casimer J. Borkowski, Oak Ridge, Tenn.

[73] Assignee: The United States of America as represented by the United States Energy Research and Development Administration, Washington, D.C.

[22] Filed: Sept. 15, 1975

[21] Appl. No.: 613,705

[52] U.S. Cl. ..... 13/31; 13/25; 13/24; 219/121 EB
[51] Int. Cl.[2] ..... H05B 7/16
[58] Field of Search ..... 13/31, 25, 20, 2, 24; 219/121 R, 121 EB

[56] References Cited
UNITED STATES PATENTS

| | | | |
|---|---|---|---|
| 2,971,039 | 2/1961 | Westeren | 13/25 |
| 3,368,022 | 2/1968 | Mescher et al. | 13/25 X |
| 3,621,324 | 11/1971 | Fink | 219/121 EB X |
| 3,644,655 | 2/1972 | Vollmer | 13/31 |
| 3,668,293 | 6/1972 | Hellwig | 13/31 |

*Primary Examiner*—R. N. Envall, Jr.
*Attorney, Agent, or Firm*—Dean E. Carlson; David S. Zachry; Louis M. Deckelmann

[57] ABSTRACT

A high temperature furnace for use above 2000°C is provided that features fast initial heating and low power consumption at the operating temperature. The cathode is initially heated by joule heating followed by electron emission heating at the operating temperature. The cathode is designed for routine large temperature excursions without being subjected to high thermal stresses. A further characteristic of the device is the elimination of any ceramic components from the high temperature zone of the furnace.

4 Claims, 1 Drawing Figure

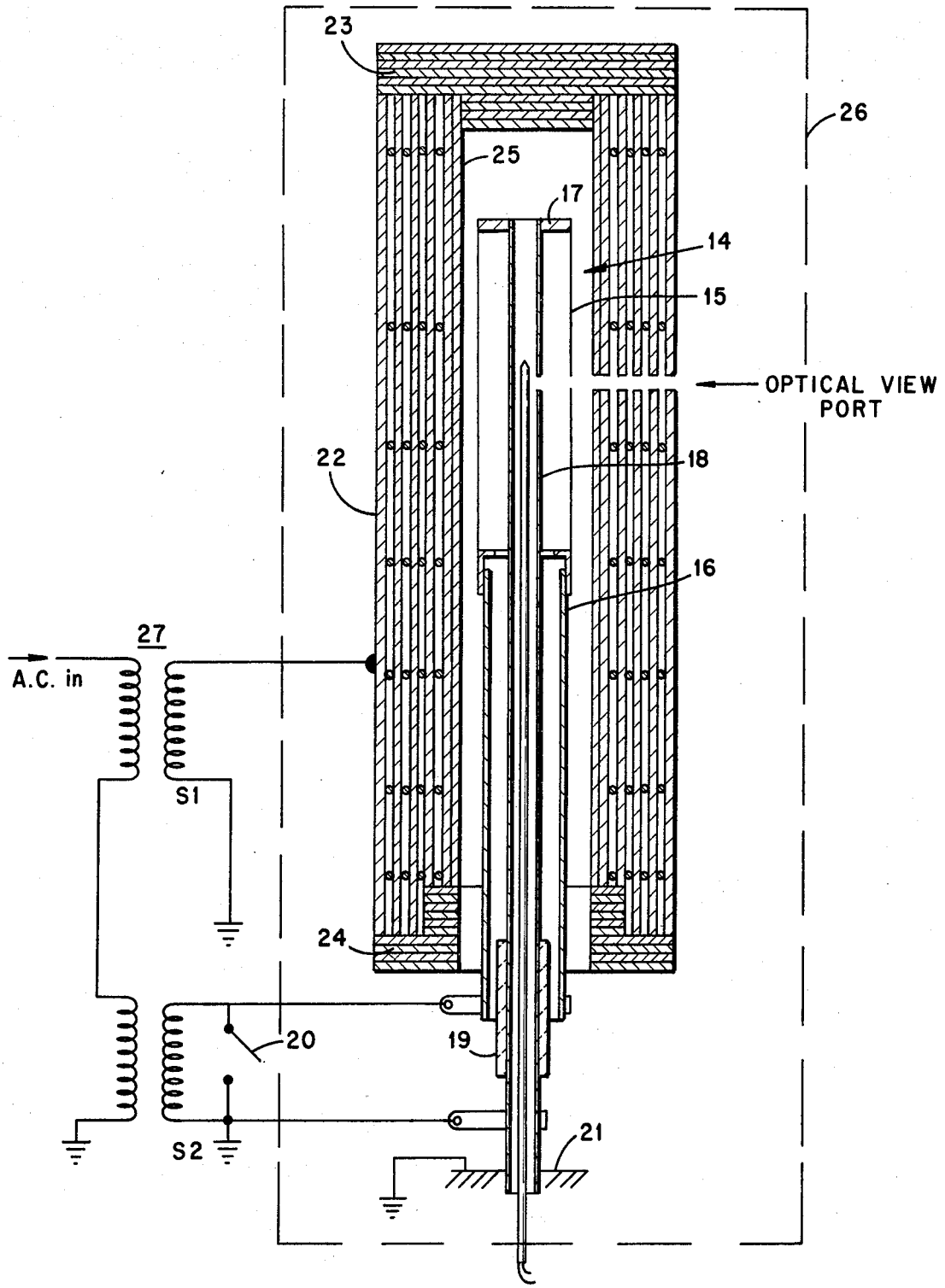
23
26
25
17
14
15
OPTICAL VIEW PORT
22
18
16
27
A.C. in
S1
24
20
19
21
S2

HIGH TEMPERATURE FURNACE

BACKGROUND OF THE INVENTION

This invention was made in the course of, or under a contract with the Energy Research and Development Administration.

High temperature vacuum furnaces are usually characterized by high power consumption and high thermal stresses during operation thereof. It would be desirable to provide a high temperature vacuum furnace that could be operated with a very low-overall power consumption, and a possible fast thermal cycling time while at the same time eliminating any deleterious thermal stresses in the region of the hot zone. The present invention was conceived to provide such a desired furnace in a manner to be described hereinbelow.

SUMMARY OF THE INVENTION

It is the object of the present invention to provide a high temperature vacuum furnace that can be operated with a low overall power consumption, and with a fast thermal cycling time, when required, without any deleterious thermal stresses occurring in the region of the hot zone of the furnace.

The above object has been accomplished in the present invention by providing a special cathode design for the furnace which permits longitudinal expansion or contraction of the cathode thus eliminating thermal stresses thereof in the region of the hot zone, and the furnace is designed in such a manner that joule (resistance) heating is initially utilized and after a short time when the furnace temperature reaches a given high temperature, the joule heating is discontinued and the furnace is then adapted to be heated to even higher temperatures by electron emission heating which is utilized as the main heating mode in a manner to be described below.

BRIEF DESCRIPTION OF THE DRAWING

The single FIGURE is a schematic illustration of the high temperature vacuum furnace and its associated power supplies of the present invention.

DESCRIPTION OF THE PREFERRED EMBODIMENT

With reference to the single FIGURE, the furnace of the present invention is shown schematically inside a vacuum enclosure 26. The cathode 14 is the principal element of the furnace and is assembled from four component parts. A cylindrical filament 15 is slipped over one end of a cylinder 16 and attached thereto, and a washer 17 is slipped over one end of a second cylinder 18 and attached thereto. The cylinder 18 is then inserted into the cylinder 16 until the washer 17 just slips into the unsupported end of the filament 15. The two cylinders are made concentric and then the filament 15 is attached to the washer 17.

The cylinder 16 can be a tantalum tube or other refractory conductor having a 0.01 inch wall thickness so as to be fairly rugged. The filament 15 is a thin-walled (0.003 inch) tantalum tube spotwelded at its ends to the tube 16 and the washer 17, respectively. The length of the filament 15 defines the length of the useful hot zone of the furnace. The cylinder 18 is another tantalum tube, also of 0.01 inch wall thickness and is of such a length that a portion of it extends beyond the open end of the tube 16. Three ceramic rods

19 made of $Al_2O_3$, for example, function both as spacers and electrical insulators between the two cylinders 16 and 18 at this end of the cathode assembly. The tube 18 may be open at one or both ends, its inside diameter defining the diameter of the hot zone (in the region of the filament 15). The hot zone may be ¾ inch in diameter by 4 inches long, for example. The whole cathode assembly is supported from a base 21.

It can be seen that a current can be passed through the filament 15 by applying AC power to the tubes 16 and 18 via one secondary winding, $S_2$, of a transformer 27. As long as power is supplied to the transformer 27, and a shunting switch 20 across the secondary $S_2$ is open, the cathode filament 15 will be directly (resistance) heated. When the switch 20 is closed, the filament 15 receives zero direct heating current, and the cathode assembly is at ground potential. An efficient thermal radiation shield that consists of side 22, top 23, and bottom 24 portions surrounds the cathode. The side heat shield 22 is connected electrically to another secondary winding $S_1$, of the transformer 27.

With the transformer 27 energized and the switch 20 open, the filament is directly heated until it emits electrons by thermionic emission. In the case of a tantalum filament, this temperature is about 1700°C. The emitted electrons begin bombarding the nearby wall 25 of the heat shield 22, raising its temperature. Since the wall 25 is a part of a radiation shield, the energy can't escape very efficiently and the temperature of this inner wall rises until it also emits electrons by thermionic emission. As soon as the wall 25 begins to emit electrons, the switch 20 can be closed to begin the main heating mode of the furnace.

With the closing of the switch 20, the cloud of electrons that is between the filament 15 and the wall 25 begins an alternating electron bombardment of the filament and wall that keeps both hot. With the filament current off (with switch 20 closed) control of the furnace temperature is now a function of the 60 cycle AC voltage supplied by the transformer secondary winding $S_1$. With the cathode in the filament region now indirectly heated by radiation heating, its thermal energy is very efficiently contained by the shields 22, 23, and 24 with resultant heating of the useful hot zone inside the tube 18.

A very important feature of the above-described furnace is the design of the cathode. It was specifically designed to prevent early failure due to thermal stresses. There are no ceramic insulators in the high temperature zone of the furnace, since the only place such insulators are used is at the base of the cathode where it is relatively cool. Since the cylinder 16 with the filament 15 affixed thereto and the cylinder 18 that make up the cathode are attached together only at the washer 17, the cylinder 16 and filament 15 are free to move longitudinally relative to the cylinder 18 with the result that no forces due to expansion and contraction of the cathode are produced.

Another important feature of the above furnace is that joule (resistance) heating is eliminated in the main heating mode. Joule heating is used only in the start-up (or ignition mode) in the first few minutes of operation prior to switching to the electron emission heating mode. Since in the main heating mode current is not passed through the thin filament 15, oxidation or the development of small high-resistance spots on the filament will not become a problem.

The side radiation shield 22 is constructed in a novel and very simple manner that can be termed as "jelly-roll" process. A very long length of shield material (0.002 inch thick tantalum) having a width equal to the height of the finished heat shield is laid out flat. A few tantalum wires having a diameter equal to the desired spacing of the finished shield layers are then laid on the flat sheet running lengthwise with the sheet length and spot-welded to the sheet at various points. The sheet is then rolled from one end on a mandrel to result in a spiral-wound heat shield with a spacing between turns equal to the wire thickness.

An optical view port is provided for observation of the hot zone inside the tube 18 as shown in the drawing. It should also be understood that a suitable glass window, not shown, is provided as a view port of the vacuum enclosure 26. The vacuum enclosure 26 is connected to a suitable vacuum pump, not shown, in a conventional manner. In addition, a thermocouple may be inserted within the cylinder 18, as shown in the drawing, for providing an indication of the furnace temperature during operation of the furnace, when such is desired, or the thermocouple itself may be the object under test.

The above-described furnace with a ¾ inch diameter by 4 inch long usable hot zone, for example, has a temperature range from about 2000°C to the melting point of any refractory materials subjected to the hot zone during the operation of the furnace. The furnace can be routinely heated to 2000°C in five minutes by applying the full power of 100 amps at 6 volts to the cathode from the transformer 27 secondary $S_2$. A temperature of 2000°C can then be maintained thereafter by the sole use of the transformer 27 secondary $S_1$ (with the switch 20 closed) with only about 300 watts of power. Thus, it should be obvious that the overall power consumption of the above furnace is relatively low, particularly when the main heating mode is utilized for long periods of time.

This invention has been described by way of illustration rather than by limitation and it should be apparent that it is equally applicable in fields other than those described. For example, the furnace of the present invention could be utilized as a controlled high temperature heat source for applications in thermal cycling experiments.

What is claimed is:

1. A high temperature furnace for operation in a vacuum comprising a first elongated metallic cylinder, an elongated thin metallic cylindrical filament having one end thereof slipped over one end of said cylinder and affixed thereto, a second elongated metallic cylinder, a base support, said second cylinder provided with a metal washer affixed to one end thereof, said washer fitting within the other end of said cylindrical filament and affixed thereto, said second cylinder extending completely through said filament and beyond the other end of said first cylinder and being mounted in said base support, a plurality of insulation spacer members mounted between the inside of said other end of said first cylinder and the outside of said second cylinder, a transformer provided with two primary windings and two secondary windings, a metallic thermal radiation shield encompassing a major portion of said elongated first cylinder and its attached filament and defining an air space therebetween, one of said transformer secondary windings being connected between said radiation shield and ground, the other one of said transformer secondary windings connected to said filament through said first cylinder and to ground with said second cylinder also connected to ground to complete a circuit through said filament, a shorting switch connected across said other one of said secondary windings, and a vacuum enclosure enclosing said base support, said filaments, said first and second cylinders, and said thermal radiation shield, whereby when said transformer is energized and said shorting switch is open, said filament is directly heated until it emits electrons by thermionic emission and when the inside wall of said radiation shield is heated up and also begins to emit electrons by thermionic emission then said shorting switch is adapted to be manually closed such that the cloud of electrons that then exist between said filament and the inside wall of said shield begins an alternating electron bombardment of the filament and said wall by means of said one secondary winding to thus keep both said filament and said shield wall hot.

2. The furnace set forth in claim 1, wherein said second cylinder is open at both ends.

3. The furnace set forth in claim 2 wherein said filament is a 0.003 inch thick tantalum tube, and said first and second cylinders are tantalum having a respective wall thickness of 0.01 inch.

4. The furnace set forth in claim 2, wherein said furnace is adapted to be operated at start-up with said shorting switch open and said filament receiving current until the furnace reaches a temperature of about 2000°C, after which said switch is closed shunting out said filament current, and said furnace is then maintained at said 2000°C by said electron bombardment of said filament and said inside shield wall as maintained by said one transformer secondary winding.

* * * * *